US006852140B1

(12) United States Patent
Roeske

(10) Patent No.: US 6,852,140 B1
(45) Date of Patent: Feb. 8, 2005

(54) LOW-SOOT, LOW-SMOKE RENEWABLE RESOURCE CANDLE

(75) Inventor: Alfred D. Roeske, Veneta, OR (US)

(73) Assignee: Cleanwax, LLC, Eugene, OR (US)

( * ) Notice: Subject to any disclaimer, the term of this patent is extended or adjusted under 35 U.S.C. 154(b) by 0 days.

(21) Appl. No.: 09/670,181

(22) Filed: Sep. 26, 2000

Related U.S. Application Data

(60) Provisional application No. 60/155,848, filed on Sep. 24, 1999, and provisional application No. 60/159,062, filed on Oct. 12, 1999.

(51) Int. Cl.[7] ..... C11C 5/00
(52) U.S. Cl. ..... 44/275; 431/288
(58) Field of Search ..... 44/275; 431/288

(56) References Cited

U.S. PATENT DOCUMENTS

| | | | | |
|---|---|---|---|---|
| 809,121 A | | 1/1906 | Lewiy | |
| 1,229,132 A | | 6/1917 | Philip | |
| 1,935,946 A | | 11/1933 | Egan et al. | 87/21 |
| 1,954,659 A | | 4/1934 | Wil | |
| 2,159,218 A | | 5/1939 | MacLaren | 67/19 |
| 3,615,284 A | | 10/1971 | Cassar | 44/1 R |
| 3,615,289 A | | 10/1971 | Felton | |
| 3,630,695 A | | 12/1971 | Dulling et al. | 44/1 R |
| 3,630,697 A | | 12/1971 | Dulling et al.. | |
| 3,645,705 A | | 2/1972 | Miller et al. | 44/7.5 |
| 3,819,342 A | | 6/1974 | Gunderman et al. | 44/7.5 |
| 3,844,706 A | * | 10/1974 | Tsaras | 431/288 |
| 3,871,815 A | | 3/1975 | Cangardel | 431/126 |
| 4,049,893 A | | 9/1977 | Kidwell, Jr. | 526/26 |
| 4,507,077 A | | 3/1985 | Sapper | |
| 4,714,496 A | | 12/1987 | Luken, Jr. et al. | 106/270 |
| 4,759,709 A | | 7/1988 | Luken, Jr. et al. | 431/288 |
| 4,790,747 A | | 12/1988 | O'Brien | 431/325 |
| 4,813,975 A | | 3/1989 | Poulina et al. | |
| 4,842,648 A | * | 6/1989 | Phadoemchit et al. | 106/244 |
| 5,171,329 A | * | 12/1992 | Lin | 44/275 |
| 5,578,089 A | | 11/1996 | Elsamaloty | 44/275 |
| 5,882,363 A | | 3/1999 | Spaulding et al. | 44/275 |
| 6,054,517 A | | 4/2000 | Spaulding et al. | 524/275 |
| 6,063,144 A | * | 5/2000 | Calzada et al. | 44/275 |
| 6,284,007 B1 | * | 9/2001 | Tao | 44/275 |

FOREIGN PATENT DOCUMENTS

| | | | |
|---|---|---|---|
| CH | 646717 | | 12/1984 |
| EP | 407913 A2 | | 1/1991 |
| JP | 63168494 | * | 7/1988 |
| JP | 404059897 A | | 2/1992 |

* cited by examiner

*Primary Examiner*—Cephia D. Toomer
(74) *Attorney, Agent, or Firm*—Medlen & Carroll, LLP

(57) ABSTRACT

A low soot, low smoke candle that in one embodiment is made of renewable resource material such as plant source material. The candle may include plant source triglycerides and free fatty acids. The free fatty acids may be plant source or other source. Lower iodine value source materials provide highly saturated triglycerides and free fatty acids that in turn are low soot, low smoke. Iodine values of 10 or less down to 1 and 0.5 or less are taught. Use of agricultural "waste" material provides economically priced source material.

17 Claims, 1 Drawing Sheet

LOW-SOOT, LOW-SMOKE RENEWABLE RESOURCE CANDLE

CROSS REFERENCE TO RELATED APPLICATIONS

This application claims the benefit of U.S. Provisional Application No. 60/155,848, filed September 24, 1999, and U.S. Provisional Application No. 60/159,062, filed Oct. 12, 1999, both entitled Smoke-Free Renewable Resource Candle and having the inventor(s) listed above.

FIELD OF THE INVENTION

The present invention relates to candles and, more specifically, to low-soot, low-smoke, economically priced candles. The present invention also relates to candles made from renewable resource material such as from plant derived material.

BACKGROUND OF THE INVENTION

Candles are often made from petroleum based wax such as paraffin wax. Prior to the development of petroleum based waxes, candles were typically made from animal fats such as tallow, etc.

Candles made from either of these two materials are disadvantageous in that they produce an undesirable amount of soot or smoke, darkening ceilings, curtains and other surfaces. Petroleum based candles are further disadvantageous in that they are from a non-renewable source, and animal based candles are objectionable to some people (because they are made from a source that is inefficiently high on the food chain, amongst other reasons).

U.S. Pat. No. 1,954,659, issued to Will on Aug. 6, 1934, for a Candle and Method of Making Same, teaches a candle that includes "50 or more vegetable oil combined with paraffin wax, stearic acid, beeswax or other waxes, if the vegetable oil, such as rapeseed oil is first hydropenated."The goal of the Will patent is to process vegetable oil in such a manner as to cause it to change from a liquid to a solid. The type of oil used by Will (e.g., high erucic-content rapeseed) and his "hydrogenation" method achieved a solidification, or "hardening," of the oil. Nonetheless, Will's use of the word "hydrogeration" has a meaning different from hydrogenation as used in the present invention. For example, circa 1930 hydrogenation was carried out using a hydrogenation catalyst that favored both (1) hydrogenation of unsaturated triglyceride fatty acid molecules and (2) isomerization of cis ("Z") fatty acid isomers to trans ("E") fatty acid isomers. Both (1) and (2) result in an increased melting point, and thus the desired "hardening" of the oil is achieved without fully hydrogenating the unsaturated triglycerides. This in turn results in a candle that is sufficiently hard for its intended purposes, but that creates an undesirable amount of smoke or soot due to unsaturated triglycerides.

By circa 1930 standards, it is estimated that the Iodine Value (IV) for hydrogenated ("hardened") rapeseed oil would have been 15 or greater because it is very high in erucic acid (approximately 20% or higher C22 mono-unsaturated fatty acid content). It should be noted that IV measurements are known in the art and IV is a measure of the degree of unsaturation of a fatty acid (whether free or as part of a triglyceride). More information is provided below concerning IVs.

With respect to lower-soot, loser-smoke candles, beeswax has been used to make candles that were purported to be less sooty and smoky than paraffin candles. The process of obtaining beeswax, however, is complicated and time consuming and, therefore, renders beeswax candles disadvantageously expensive. Additionally, modern testing of beeswax candles has shown that while they may have a lower propensity to soot than paraffin candles, it is still undesirably high.

SUMMARY OF THE INVENTION

Accordingly, it is an object of the present invention to provide a soot-free, low-smoke candle that is made substantially from renewable resources.

It is another object of the present invention to provide such a candle that is economically priced.

It is also an object of the present invention to provide such a candle that includes hydrogenated plant oils having low IV values.

These and related objects of the present invention are achieved by use of a low-smoke, low-soot renewable resource candle as described herein.

In one embodiment, the present invention includes a candle comprised substantially of hydrogenated plant source triglycerides having an iodine value of less than 10. Other embodiments include a similarly composed candle having an iodine value of 7.5,5,3,1 or 0.5 or less. The triglyceride material may be from plant source material (in whole or in part). A free fatty acid component is preferably provided in combination with the triglyceride material and the concentration of this component may vary. This component may similarly be provided in whole or in part from plant source material. Furthermore, the iodine value of the free fatty acid material is preferably less than 10,7.5,5,3,1 or 0.5.

The attainment of the foregoing and related advantages and features of the invention should be more readily apparent to those skilled in the art, after review of the following more detailed description of the invention taken together with the drawings.

DETAILED DESCRIPTION

The present invention achieves low-soot, low-smoke candles by virtue in part of using triglyerides (TGs) and free fatty acids (FFAs) that have low Iodine Values (IVs). IV for purposes of the present invention is a measure of the unsaturation of fats and oils and is expressed in terms of the number of centigrams of iodine absorbed per gram of sample (% iodine absorbed). The preferred measurement protocol is Official Method Cd 1d-92 of the American Oil Chemists Society, though other protocols may be used. IVs are an indication of the degree of unsaturation within the triglycerides and/or free fatty acids, and the amount of unsaturated triglycerides and/or free fatty acids is proportional to the amount of undesired combustion products (i.e., soot and smoke, etc.). Thus, reducing the level of unsaturation reduces IV and also reduces the potential for soot and smoke production.

The present invention includes triglyceride material with IVs below 10 and, for example, includes candles ith IVs less than 8,5,3 and 1, etc. In a more preferred embodiment of the present invention, the IV of the triglyceride and fatty acid components are less than one, both individually and in combination.

In the text that follows, various component combinations are disclosed that are directed towards creating an inexpensive, clean burning candle. It should be understood that the component triglycerides and/or free fatty acids have low IVs due to contemporary hydrogenation techniques and capabilities. IVs for various components and hydrogenation consideration are discussed in more detail below.

Figure 1:
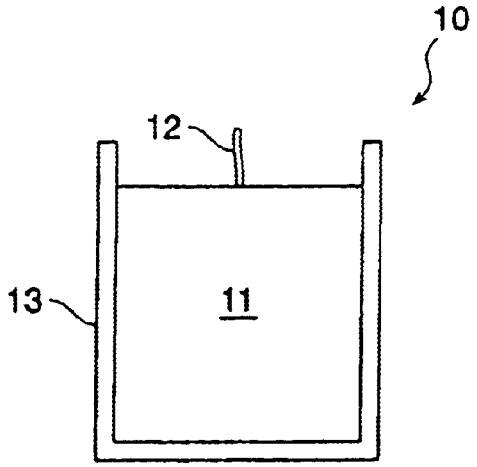
FIG. 1 is a diagram of a candle in accordance with the present invention.

Referring to FIG. 1, a diagram of a candle 10 in accordance with the present invention is shown. The candle of FIG. 1 (in votive 13 or non-votive form) may include varied components and/or component combinations without departing from the present invention. These varied arrangements include a candle made from:

I. Plant source triglycerides;

II. Plant source triglycerides and free fatty acids;

III. Plant source triglycerides and plant source free fatty acids.

Figure 2:
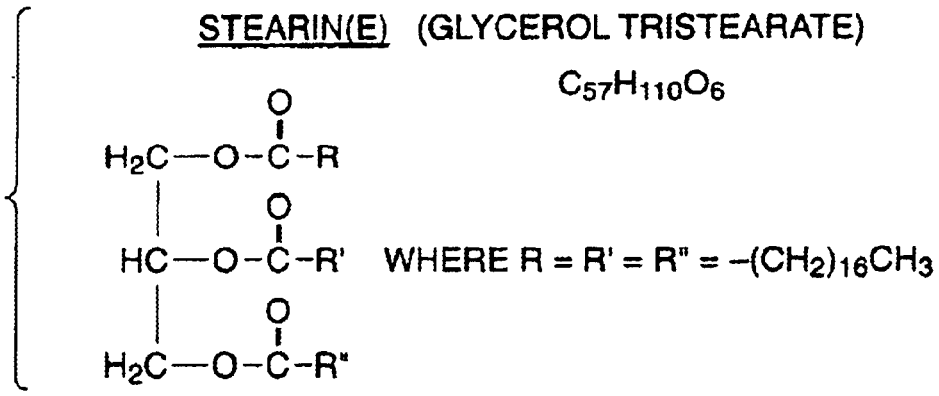
FIG. 2 is a diagram of a triglyceride in accordance with the present invention.
Figure 3:
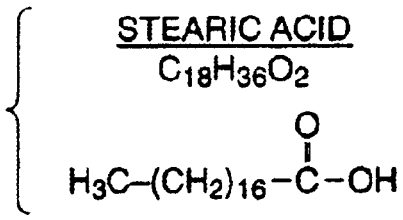
FIG. 3 is a diagram of a free fatty acid in accordance with the present invention.

In a preferred embodiment, candle 10 is made of plant source triglycerides (TGs) and plant source free fatty acids (FFAs). Representative chemical structures for these molecules are shown in FIGS. 2 and 3, respectively. Preferably, candle 10 is made of palm stearine (the plant source TG) and vegetable-derived stearic acid (a eutectic mix of primarily palmitic and stearic acids) as the FFA.

TG and FFA

A candle made from TG alone will have a bright flame and burn relatively rapidly. A candle made from FFA alone will have a low flame and burn more slowly. By mixing these two products together a candle can be achieved that has an appealing, steady flame and that burns relatively slowly.

In one embodiment, the mix of FFA to TG for a preferred candle burn is at least 2% to 35% by weight FFA, and most preferably is approximately 4% to 22% by weight FFA. Most preferably, such FFA is plant source FFA. In another embodiment, the mix of FFA to TG for a preferred candle burn is at least 40% by weight TG, and most preferably at least 70% by weight TG. Again, most preferably, such TGs are plant source TGs.

Palm Stearine or related TG

Palm stearine (a hydrogenated TG) is preferred because palm stearine is currently a low-cost by-product of palm oil processing and therefore readily available and inexpensive. Furthermore, palm stearine and related plant source TGs are derived from a renewable, non-animal source. These qualities are highly sought after as our society moves towards sustainable resource practices. Also, plant source TGs and FFAs tend to have lower odors.

Candle 10 is preferably made as follows. Palm stearine is available commercially and is usually shipped as flakes. This flaked material can be provided having the lower and more desired IVs of the present invention. In one embodiment, a preferred IV of the TG component is less than 1.0 and more preferably approximately 0.5 or less. The FFA vegetable stearic acid is similarly commercially available, shipped as flakes and is provided having the lower and more desired IVs of the present invention. In one embodiment, a preferred IV for the FFA component is less than 1.0 and more preferably approximately 0.5 or less. These components are preferably melted at temperatures of approximately 180 degrees F. and then mixed and poured into a mold about wick 12. The molten wax cools to form the candle body 11. Wick 12 is preferably a paper core cotton wick.

While the percentage of BEG and FFA will vary based on the container in which the candle as provided (for example with votives), the desired burn characteristics, and to some extent the source of TGs and FFAs, a preferred blend with palm stearine as the TG is approximately 88% TG and 12% FFA by weight. As noted above these percentages may range considerably, from more than 50% FFA to 0% FFA. It should be recognized that currently FFA is relatively more expensive than TG.

While palm stearine and vegetable stearic acid are more preferred, it should be recognized that other TGs and FFAs are suitable and included within the present invention. A partial list of raw material sources for these other TG and FFA raw materials is provided a few paragraphs below. These TGs include those that have a melting point between approximately 110 and 170 degrees F. (and it should be recognized that commercial TGs may have small quantities of diglyceride and monoglyceride components). These TGs preferably have highly saturated C16 and/or C18 fatty acid molecules (or predominantly have these molecules) which give the desired melt point.

Triglycerides that contain higher fatty acid homologues, such as C20 and C22 and even C24, would also be usable and would tend to give higher melting points.

Techniques for separating out and hydrogenating triglycerides and fatty acids of specific lengths are known in the art. It should also be recognized that hydrogenated or saturated molecules are preferred because they result in less combustion by-product (i.e., soot, smoke).

Utilizing known separation and hydrogenation techniques (discussed below) any fat, oil or wax that contains relatively high quantities (approximately 50% or greater in total) of C12, C14, C16 and/or C18 fatty acids in the triglyceride molecule is a suitable source candidate for the triglyceride(s) and/or free fatty acid(s) of the present invention. Thus, in addition to palm oil, the TGs and/or FFAs of the present invention may be derived from the oil of rapeseed, canola, soybean, corn, cottonseed, olive, peanut, perilla, linseed, candlenut, rubberseed, safflower, poppy, walnut, tobacco, niger, sunflower, sesame, meadowfoam, kukui nut, macadamia nut, coconut and cocoa amongst other seeds and/or nuts. It also should be recognized that the FFA may be obtained from animal (e.g., tallow), petroleum or other non-plant sources; additionally, the TGs may be obtained from non-plant sources as well but this is less desirable.

As alluded to above, to affect even better candle burning properties it is advantageous to add a saturated fatty acid such as stearic and/or palmitic acid to the triglyceride candle wax material. It is possible to use a behenic acid (C20), saturated C22 fatty acid, saturated C24 fatty acid, myristic acid (C14) or lauric acid (C12), or a combination of these or other fatty acids. The result is a longer burning, more even burning candle flame that is desirable for a more controlled, modulated burn. Unsaturated fatty acids are not desirable in that they may lead to incomplete combustion and sooting and would also further depress the melting point.

Hydrogenation and IV

The TGs used in the present invention are preferably based on various natural sources previously listed. The oils that are isolated from these natural sources are typically in liquid or semi-solid form and must be hydrogenated to yield the desired solid, waxy material from which a candle can be made. In the case of palm stearine, the starting material is palm oil or palm kernel oil and the "solid" portion which becomes palm stearine is isolated by chemical physical means to separate from the more valuable palm oil. This crude solid palm stearine is then refined, bleached, and deodorized (RBD) to yield a RBD palm stearine that is semi-solid to solid at ambient temperature. This material is then hydrogenated to "harden" it. The hydrogenation is carried out with a suitable hydrogenation catalyst under hydrogen pressure and at elevated temperature. The hydrogenation is carried out until the RBD palm stearine is hardened and continues until the triglyceride material has a desired IV.

A triglyceride composition that is low in fatty unsaturation and has a lower propensity to soot as a fuel. Propensity to soot is a function of many variables, two of which are: 1) the degree of "unsaturation" (abundance of carbon—carbon double bonds) and 2) the scarcity of oxygen in the chemical structure of the substrate being burned. The higher the level of unsaturation (in the chemical structure) the greater the propensity to soot (conversely, the lower the level of unsaturation the lower the propensity to soot); the lower the level of oxygen (in the chemical structure) the greater the propensity to soot (conversely, the higher the level of oxygen the lower the propensity to soot). Since the triglyceride contains a high level of oxygen in the chemical structure (the triesters of glycerine and three fatty acids) the level of unsaturation becomes a key variable in determining propensity to soot.

While embodiments of candles having IVs of 1 or 0.5 or less are specifically discussed above, candles having IVs of 10 or less are within the present invention. The present invention recognizes that modern hydrogenation techniques may be practiced up to the point where healthful, low smoke, low-soot, renewable (or like) candles are achieved. Lower IVs are achieved with increased substrate processing (i.e., hydrogenation) and, increasing processing typically leads to increased cost of substrate material. Thus, a candle with IV of 10 may have a cost that is less than that of a candle having an IV of 7.5, for example, or a candle having an IV of 5. With improvements in hydrogenation processing, however, the efficacy and cost of hydrogenation has decreased. This permits that attainment of TG and/or FFA materials having IVs of 3, 1, 0.5 or less that are still favorable and economically priced. For persons who are most sensitive to combustion products or have other respiratory or soot/smoke sensitive conditions, a candle having an IV of 0.5 to 1 and perhaps up to 3 is going to be preferred. Persons seeking a clean burning candle, yet are less sensitive may prefer a candle with an IV ranging from 3 to 7.5 or the like. Other persons who want a cleaner candle, yet are very cost sensitive may prefer a candle from 7.5 to 10. Note that these criteria include generalizations and material costs may vary based on supply and demand amongst other parameters.

While specific IV values are provided here, it should be recognized that the present inventions contribution of more fully hydrogenated plant source TGs and low soot, low smoke candles should not be limited by a specific number. The present invention is intended to cover candles of all IV below those taught by the prior art, particularly for candles containing plant source TGs.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A candle composition substantially comprising hydrogenated plant source triglycerides in combination with a non-plant source free fatty acid, said candle composition having an iodine value of less than 5, whereby when said candle composition is burned substantially no soot is produced.

2. The candle composition of claim 1, wherein said iodine value is less than 3.

3. The candle composition of claim 1, wherein said iodine value is less than 1.

4. The candle composition of claim 1, wherein said free fatty acid is selected from the group consisting of an animal free fatty acid and a petroleum free fatty acid.

5. The candle composition of claim 1, wherein said plant source triglycerides and said free fatty acid each have an iodine value of 1 or less.

6. The candle composition of claim 1 including from 2% to 35% by weight free fatty acid.

7. The candle composition of claim 1 including approximately 4% to 22% by weight free fatty acid.

8. A candle consisting essentially of triglycerides, free fatty acids, and a wick, said candle having an iodine value of less than 1, whereby when said candle is burned substantially no soot is produced.

9. The candle of claim 8, wherein said candle includes at least 40% by weight triglyceride.

10. The candle of claim 8, wherein said candle includes at least 70% by weight triglyceride.

11. The candle of claim 8, wherein said candle includes at least 4% by weight plant source free fatty acid.

12. The candle of claim 8, wherein said candle includes at least 4% by weight non-plant source free fatty acid.

13. The candle of claim 8, having an iodine value of less than 0.5.

14. The candle of claim 8, wherein said triglyceride is a plant-source triglyceride and said free fatty acid is a non-plant source free fatty acid.

15. A candle comprised substantially of hydrogenated triglycerides, hydrogenated free fatty acids, and a wick, wherein said hydrogenated triglycerides are derived from an oil selected from the group consisting of rapeseed oil, olive oil, peanut oil, perilla oil, linseed oil, candlenut oil, rubberseed oil, safflower oil, poppy oil, walnut oil, tobacco oil, niger oil, sesame oil, meadowfoam oil, kukui nut oil, macadamia nut oil, coconut oil and cocoa oil, said candle having an iodine value of less than 5, whereby when said candle is burned substantially no soot is produced.

16. The candle of claim 15 having an iodine value of less than 3.

17. The candle of claim 15, having an iodine value of less than 1.

* * * * *